US005442131A

United States Patent [19]

Borgwarth

[11] Patent Number: 5,442,131

[45] Date of Patent: Aug. 15, 1995

[54] HIGH ENERGY COAXIAL CABLE COOLING APPARATUS

[76] Inventor: Dennis Borgwarth, 3267 13th Ave., Anoka, Minn. 55303

[21] Appl. No.: 96,354

[22] Filed: Jul. 23, 1993

[51] Int. Cl.[6] ..... H01B 7/34

[52] U.S. Cl. ..... 174/15.6; 62/259.2; 165/104.33; 174/15.7; 174/19; 361/699; 361/701; 428/53; 428/167; 428/192

[58] Field of Search ..... 174/15.6, 15.7, 19, 174/8, 15.1, 15.2; 361/699, 701; 428/53, 167, 192; 165/169, 104.33; 62/259.2

[56] References Cited

U.S. PATENT DOCUMENTS

| | | | |
|---|---|---|---|
| 2,306,850 | 12/1942 | Usselman | 174/15.6 |
| 2,658,939 | 11/1953 | Greenfield et al. | 174/24 |
| 3,746,607 | 7/1973 | Harmon et al. | 428/167 |
| 4,576,846 | 3/1986 | Noel | 428/192 |
| 4,626,456 | 12/1986 | Farrell et al. | 428/167 |
| 4,853,516 | 8/1989 | Julien et al. | 174/15.7 |
| 5,208,087 | 5/1993 | Stigberg | 428/167 |

FOREIGN PATENT DOCUMENTS

| | | | |
|---|---|---|---|
| 1133077 | 10/1982 | Canada | 174/15.6 |
| 1291003 | 3/1969 | Germany | 174/15.6 |
| 1540452 | 1/1970 | Germany | 174/15.6 |
| 2345743 | 3/1975 | Germany | 174/15.6 |
| 875930 | 8/1961 | United Kingdom | 174/15.6 |
| 887029 | 1/1962 | United Kingdom | 174/15.6 |

*Primary Examiner*—Morris H. Nimmo
*Attorney, Agent, or Firm*—H. M. Stanley; G. Wolde-Michael; R. C. Kamp

[57] ABSTRACT

A system is provided for cooling a flexible high energy coaxial cable wherein cooling fluid is circulated along the cable and through a heat exchanger to dissipate the cable heat generated by the high energy transferred by the cable. The cable has inner and outer concentric conductors separated by an inner dielectric layer and surrounded by an outer dielectric layer. Channels in the two dielectric layers provide for the fluid flow along the cable which carries away the heat.

6 Claims, 2 Drawing Sheets

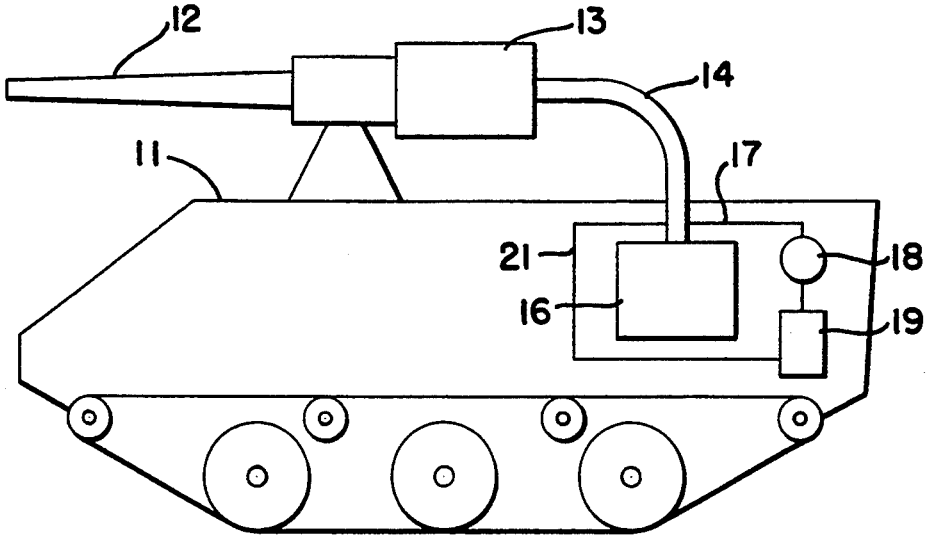
FIG_1
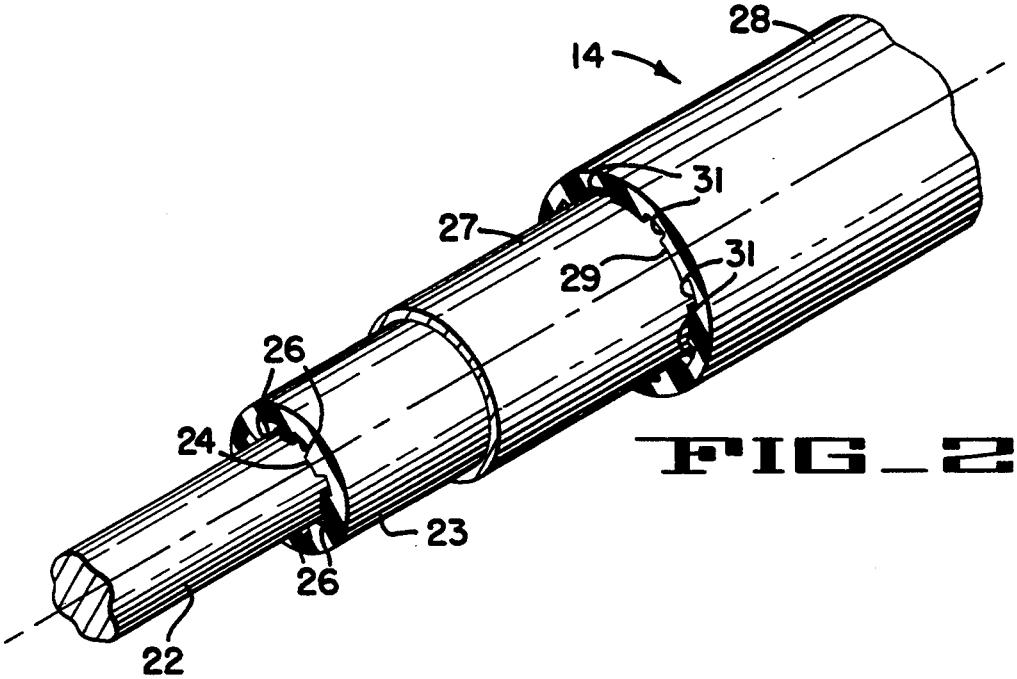
FIG_2
FIG_4
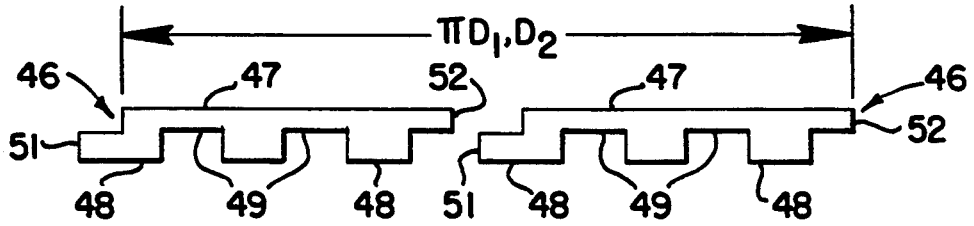

HIGH ENERGY COAXIAL CABLE COOLING APPARATUS

CROSS-REFERENCE OF RELATED APPLICATION

SUMMARY OF THE INVENTION

This invention relates to an electrical insulation the for providing longitudinally disposed channels which guide fluid flow along enclosed electrical conductor and includes at least one elongate insulation strip having a flat side and an opposing side. The opposing side has at least one open channel extending lengthwise along the strip. The insulation strip has first and second opposing edges which intersect the flat side and opposing side. The first and second opposing edges have mating joint elements thereon so that when one of the first and one of the second opposing edges are joined an insulation tube is formed having an inside and an outside wall with the open channel extending along the adjacent to the enclosed conductor.

This invention also relates to a coaxial cable assembly having first and second ends which includes a center conductor and a first insulating layer surrounding the center conductor. The first insulating layer has an inner wall in contact with the center conductor and has at least one elongate channel formed along the inner wall. A second return conductor surrounds the first insulating layer a second insulating layer surrounds the second return conductor. The second insulating layer has an inner wall in contact with the second return conductor and there is at least one elongate channel formed in the inner wall of the second insulating layer. Connector means is attached to the center conductor at the first cable assembly end. The connector means has a chamber which is in communication with both the first and second insulating layer inner wall panels. The elongate channels in the inner walls of the first and second insulating layers are accessible from the second cable assembly end. A heat pipe extends from the connector means into the connector means chamber.

Additionally, the invention disclosed herein relates to a high energy coaxial cable cooling system wherein inner and outer coaxial conductors have opposing first and second connector ends. An inner coaxial insulation layer is disposed between the inner and outer coaxial conductors and has an inner wall adjacent the inner coaxial conductor with at least one elongate channel formed in the inner wall. An outer coaxial insulation layer has an inner wall adjacent to and surrounding the outer coaxial conductor and has at least one elongate channel in the inner wall thereof. Means is provided at the inner and outer coaxial conductor first connector end for communicating the elongate channel in the inner wall of the inner coaxial insulation layer with the elongate channel in the inner wall of the outer coaxial insulation layer. A high energy electrical source is connected to the inner and outer conductor second connector end and a heat exchanger having an input side and an output side is connected so that the input and output sides thereof communicate with separate ones of the elongate channels in the inner wall of the inner coaxial insulation layer and the inner wall of the outer coaxial insulation layer. Pump means is connected between the heat exchanger and the inner and outer coaxial insulation layer elongate channels so that a cooling medium is urged by the pump to flow through the coaxial cable elongate channels and the heat exchanger. A method is disclosed for manufacturing an electrical insulation tube for surrounding an electrical conductor and for providing longitudinally disposed cooling channels adjacent to the electrical conductor. The method includes the steps of fabricating an elongate insulation strip and forming one side of the elongate insulation strip in a flat configuration. An opposing side of the elongate insulation strip is configured to have at least one open channel extending lengthwise thereof. Additionally a first mating element is formed on a first edge of the elongate insulation strip and a second mating element is formed on a second opposing edge of the elongate insulation strip. At least one elongate insulation strip is cut to a predetermined length and one of the first mating elements is joined to one of the second mating elements to form a tube having the open channel extending along the interior of the tube.

BRIEF DESCRIPTION OF THE DRAWINGS

FIG. 1 an elevation view which shows the coaxial cable cooling system of the present invention mounted on a tracked gun platform for illustration purposes.

FIG. 2 is a cut away perspective view of the cooled coaxial cable of the present invention.

FIG. 4 is an end view of the coaxial cable insulation elements of the present invention.

DESCRIPTION OF THE PREFERRED EMBODIMENTS

Figure 3:
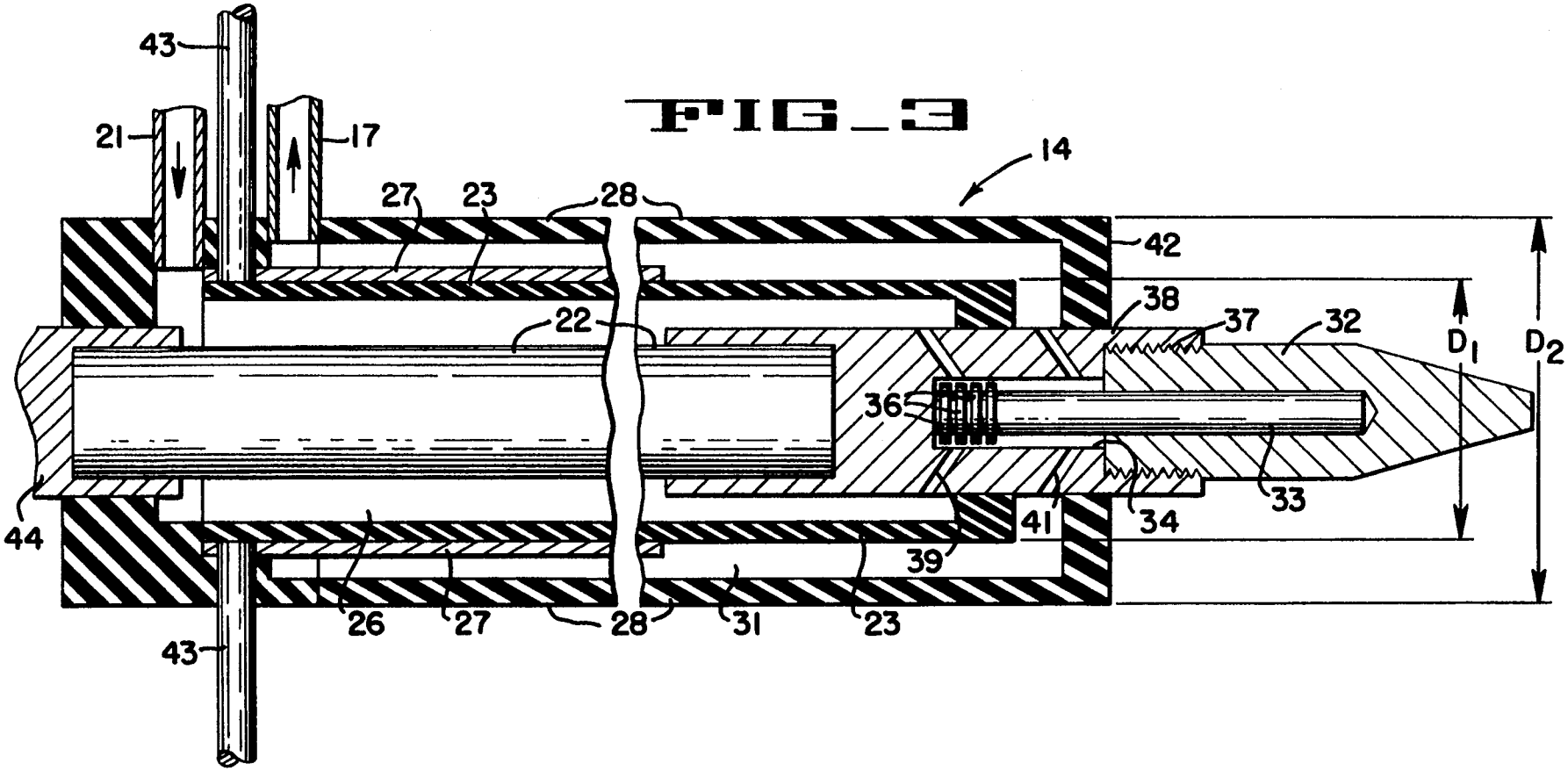
FIG. 3 is a section along the length of the coaxial cable assembly showing the opposing connection ends.

In FIG. 1 of the drawings the high energy coaxial cable cooling system of the present invention is shown installed on a tracked gun platform 11. A gun 12 has a breech 13 which has the gun end of a high energy coaxial cable 14 attached thereto. The opposite end of the coaxial cable is attached to a high energy pulse forming network 16 mounted on the gun platform 11. The coaxial cable 14 has a cooling liquid outflow line 17 connected thereto which is also connected to a pump 18. The coaxial cable 14 has fluid flow passages therein, to be described hereinafter, whereby fluid is caused to flow from within the coaxial cable by the pump 18 to a heat exchanger 19. The heat exchanger removes heat from the fluid and has connected thereto an outflow fluid line 21 which is in turn connected to an inflow port, also to be described later herein, on the flexible high energy coaxial cable 14.

The coaxial cable 14 is shown in cut away form in the diagram of FIG. 2. A flexible inner conductor 22 is shown surrounded by an inner layer of dielectric material 23. The inner layer of dielectric material has an inner wall 24 in contact with the inner electrical conductor 22. The inner wall 24 has one or more longitudinally disposed channels 26 through which a cooling fluid may be caused to flow. The cooling fluid could be any one of several appropriate non-dielectric coolants. One of the many such coolants which could be used in this application is Fluorinet TM a 3M product. Surrounding the inner layer 23 of dielectric material is an outer conducting layer 27 which extends the length of the flexible coaxial cable 14. Wrapped around the outside surface of the outer electrical conductor 27 is an outer dielectric layer 28 having an inner wall 29 in contact with the outside surface of the outer conductor 27. The inner wall 29 has one or more longitudinally disposed channels 31 formed therein through which the aforementioned cooling fluid may be caused to flow.

The coaxial cable assembly of FIG. 2 may be seen in FIG. 3 in a configuration which extends between the gun end of the coaxial cable 14 having a gun end contact or connector 32 extending therefrom, and the power supply end of the coaxial cable having the outflow fluid conduit 17 and the inflow fluid conduit 21 extending therefrom. It should be noted that the contact 32 of FIG. 3 serves a purpose similar to that described for the contact probe disclosed in U.S. Pat. No. 5,220,126, as item number 11 therein and currently assigned to the same assignee. The high energy flexible coaxial cable 14 disclosed herein is designed for transferring more than two megajoules of electrical power and over 280 kiloamps for short durations on the order of 2.5 milliseconds from the pulse forming network or pulse source 16 to electrothermal ammunition in the breech 13 of a combustion augmented plasma gun such as contained on gun 12 in FIG. 1. With such high levels of power transfer high heat levels must be dissipated in the flexible coaxial cable component parts. As will now be described the construction of the coaxial cable 14 disclosed herein affords such heat dissipation.

Turning again to FIG. 3, the gun end contact 32 is shown having a heat pipe 33 disposed along the core thereof. The heat pipe extends rearwardly from the gun end contact 32 into a chamber 34 which is included in the flow path of the cooling fluid to be described. The distal end of the heat pipe 33 has a number of fins 36 formed thereon to expedite heat loss from the heat pipe to the cooling fluid being circulated through the chamber 34. The gun end contact 32 is fastened, by means of threads 37, for example, into an adapter 38 which couples the contact 32 to the center conductor 22. The inner insulating layer 23 is shown surrounding the center conductor 22 in contact therewith and having channels 26 running therealong. A flow port 39 is formed within the adapter 38 to communicate each channel 26 with the chamber 34 containing the after end of the heat pipe 33. The chamber 34 also has flow ports 41 formed therein to communicate the chamber with each of the channels 31 in the outer insulating layer 28. The outer conductor 27 is shown exposed to fluid flow through the elongate channels 31 which in turn are shown connected to the flow path through the outflow tube 17 in FIG. 3. The inflow tube 21 is shown with its flow path in communication with the flow channel 26 in the inner dielectric layer 23. As a result it may be seen that cooling fluid from the heat exchanger 19 enters through inflow conduit 21 into the flexible high power coaxial cable inner insulating layer channels 26, flows through flow ports 39 into chamber 34, through flow ports 41 into channel 31 and exits the coaxial cable assembly throughout outflow conduit 17. It may also be seen that the number of channels 26 and 31 may be varied in number or size to provide appropriate cooling for specific applications.

The outer or return conductor 27 is connected to the return path in the gun (not shown) at the gun end of the cable assembly of FIG. 3 through the outer dielectric layer 28 between the channels 31 on the inside wall of the outer dielectric layer. Alternatively, the outer conductor 27 may exit the gun end of the flexible high energy coaxial cable 14 from a gun end wall 42 on the outer dielectric layer 28. In any event, whatever means of access is provided at the gun end of the coaxial cable for the outer conductor 27, it is only necessary to provide an appropriate seal so that cooling fluid in the channel 31 does not escape therefrom.

At the power supply end of the coaxial cable 14 the outer conductor 27 is shown connected to one or more radially extending connecting wires 43. The power supply end of the center conductor 22 being attached to a conducting adapter 44 at the power supply end of the coaxial cable 14, access being provided to the center conductor at the pulse forming network 16 therethrough. As a result a complete circuit is provided for the transmission of high energy pulses through the flexible coaxial cable 14 from the pulse forming network 16 through the power supply end adapter 44, center conductor 22, contact 32, the ammunition cartridge (not shown), breech 13, the return conductor 27, and the connecting conductors 43 to the pulse forming network 16.

In FIG. 3 the outside diameter of the inner insulating layer 23 is seen as. $D_1$. The outside diameter of the outer insulating layer is seen as $D_2$. FIG. 4 shows an end view of a dielectric strip 46 with the long dimension of strip extending in and out of the paper. Two such strips 46 are shown for illustrative purposes. Each strip 46 may, by itself or in combination with other such strips, be connected together edge to edge to form a layer of electrical insulation material wherein each strip has a flat side 47 and an opposing inner side 48 having one or more open channels 49, representing channels 26 and 31, extending along the inner side. Each strip 46 has opposing edges 51 and 52 so that parallel strips may be joined at the opposing edges to form, in the illustrated embodiment, a lap joint where edge 52 of one strip and edge 51 of an adjacent strip 46 come together. When a series of joined strips 46, or one single strip for that matter, are folded about a lengthwise strip axis and joined edge to edge, an insulation conduit is formed having an inside and an outside wall with the open channels 49 on the inside wall. If the outside diameter of an inner insulating layer 23 $D_1$ is known, such an inner insulating layer may be formed by placing together sufficient elongated strips 46 so that the dimension $\pi D_1$ of FIG. 4 is obtained. The inner insulation layer may then be folded and joined edge to edge as previously described to form the layer 23 with the channels 26 on the inside wall thereof. In like manner, the outer insulating layer 28 may be formed when the outside diameter $D_2$ (FIG. 3) is known by fastening in edge to edge relation a sufficient number of elongate strips 46 to provide the dimension $\pi D_2$ of FIG. 4.

Although the best mode contemplated for carrying out the present invention has been herein shown and described, it will be apparent that modification and variation may be made without departing from what is regarded to be the subject matter of the invention.

What is claimed is:

1. An electrical insulation tube for providing a plurality of longitudinally disposed channels for guiding fluid flow along the length of an enclosed electrical conductor, comprising a plurality of elongate insulation strips each having opposing ends, a flat side on each of said elongate insulation strips, an opposing side on each of said elongate insulation strips having at least one open channel extending lengthwise therealong, first and second opposing edges on each of said elongate insulation strips intersecting said flat side and said opposing side, and mating edge means formed on said first and second opposing edges for joining adjacent ones of all of said first and second opposing edges on adjacent ones of said plurality of elongate insulation strips, for forming an insulation tube whereby said plurality of insulation strips when all joined edge to edge form an insulation tube having an inside and an outside wall with said at least one open channel in each insulation strip on said inside wall adjacent to the enclosed electrical conductor.

2. A coaxial cable assembly having first and second ends, comprising a center conductor, a first insulating layer surrounding said center conductor and having an inner wall in contact therewith, said first insulating layer having at least one elongate channel formed in said inner wall, a second return conductor surrounding said first insulating layer, a second insulating layer surrounding said second return conductor and having an inner wall in contact therewith, said second insulating layer having at least one elongate channel formed in said inner wall, and connector means attached to said center conductor at said first cable assembly end, said connector means having a chamber therein in communication with said first insulating layer inner wall elongate channel and said second insulating layer inner wall elongate channel, said first insulating layer inner wall elongate channel and said second insulating layer inner wall elongate channel being accessible from said second cable assembly end, and a heat pipe extending from said connector means into said chamber.

3. The coaxial cable assembly of claim 2 wherein said first and second insulating layers have a plurality of elongate channels formed in said inner walls thereof.

4. A high energy coaxial cable cooling system comprising inner and outer coaxial conductors having opposing first and second connector ends, an inner coaxial insulation layer disposed between said inner and outer coaxial conductors, having an inner wall adjacent said inner coaxial conductor and having at least one elongate channel in said inner wall, an outer coaxial insulation layer having an inner wall adjacent to and surrounding said outer coaxial conductor and having at least one elongate channel in said inner wall, means at said inner and outer coaxial conductor first connector end for communicating said elongate channel in said inner wall of said inner coaxial insulation layer with said elongate channel in said inner wall of said outer coaxial insulation layer, a high energy electrical source connected to said inner and outer conductor second connector end, heat exchanger means having an input side and an output side, said input and output sides communicating with separate ones of said elongate channel in said inner wall of said inner coaxial insulation layer and said elongate channel in said inner wall of said outer coaxial insulation layer, and pump means connected between said heat exchanger means and said inner and outer coaxial insulation layer elongate channels, whereby cooling medium is urged by said pump to flow through the coaxial cable elongate channels and heat exchanger.

5. The high energy coaxial cable cooling system of claim 4 wherein said inner and outer coaxial insulation layer channels comprise a plurality of channels.

6. A method of manufacturing an electrical insulation tube for surrounding an electrical conductor and for providing longitudinally disposed cooling channels adjacent to the electrical conductor comprising the steps of fabricating an elongate insulation strip, forming one side of the elongate insulation strip in a flat configuration, configuring an opposing side of the elongate insulation strip to have at least one open channel extending lengthwise therealong, forming a first mating element on a first edge of the elongate insulation strip, forming a second mating element on a second and opposing edge of the elongate insulation strip, cutting at least one elongate insulation strip to predetermined length, and joining a first mating element to a second mating element to form a tube having at least one open channel extending along the interior thereof.

* * * * *